US009169057B2

(12) United States Patent
Bookhamer

(10) Patent No.: US 9,169,057 B2
(45) Date of Patent: Oct. 27, 2015

(54) FOOTWEAR CARRIER: SHOE HOLDING SUPPORT STRUCTURE

(76) Inventor: Ryan Scott Bookhamer, Edinboro, PA (US)

( * ) Notice: Subject to any disclaimer, the term of this patent is extended or adjusted under 35 U.S.C. 154(b) by 1805 days.

(21) Appl. No.: 12/348,883

(22) Filed: Jan. 5, 2009

(65) Prior Publication Data

US 2009/0173647 A1 Jul. 9, 2009

Related U.S. Application Data

(60) Provisional application No. 61/019,230, filed on Jan. 4, 2008.

(51) Int. Cl.
*B65D 73/00* (2006.01)
*B65D 85/18* (2006.01)
*A45F 5/02* (2006.01)

(52) U.S. Cl.
CPC . *B65D 85/18* (2013.01); *A45F 5/02* (2013.01); *A45F 2200/0566* (2013.01)

(58) Field of Classification Search
CPC .... B65D 85/18; B65D 85/182; A61B 19/045; A47G 25/54; A45C 3/12
USPC ..... 206/278, 293, 294, 315.1, 525, 749; 294/148, 143, 145, 162, 166; D3/289, D3/290, 302
See application file for complete search history.

(56) References Cited

U.S. PATENT DOCUMENTS

| | | | | | |
|---|---|---|---|---|---|
| D140,519 | S | | 3/1945 | Pascal | |
| 2,832,389 | A | | 4/1958 | Smith | |
| 4,624,496 | A | * | 11/1986 | Bengtson | 294/148 |
| 4,703,850 | A | * | 11/1987 | Walker | 206/293 |
| D293,626 | S | * | 1/1988 | Beran | D3/290 |
| 4,917,290 | A | | 4/1990 | Saiki et al. | |
| D395,752 | S | | 7/1998 | Foster | |
| D444,944 | S | | 7/2001 | Smith et al. | |
| D453,994 | S | | 3/2002 | Meissner | |
| 6,669,016 | B1 | | 12/2003 | Carson | |
| D504,230 | S | | 4/2005 | Thomas | |
| D547,063 | S | | 7/2007 | Soetardjo et al. | |
| 2006/0231602 | A1 | * | 10/2006 | Mu et al. | 229/125.015 |

* cited by examiner

*Primary Examiner* — Fenn Mathew
*Assistant Examiner* — Cynthia Collado
(74) *Attorney, Agent, or Firm* — Blynn L. Shideler; Krisanne Shideler; BLK Law Group

(57) ABSTRACT

A light weight, molded foot wear carrier consists of a body forming two open cavities with a dividing wall between the cavities. Each body formed cavity is open on a top end there of for easy footwear insertion. The carrier has straps, which may be adjustable, to hold the footwear in a secure position inside the carrier, with one strap extending across each opening for each cavity. The footwear is held upright for ease of insertion and removal. The straps may be formed as elastomeric straps that may be adjustable to hold footwear of various geometries.

20 Claims, 3 Drawing Sheets

FIG. 6
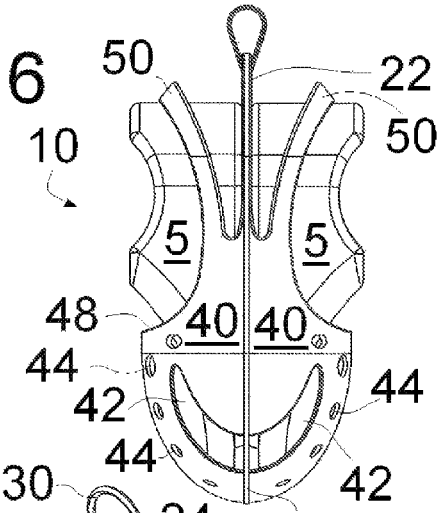
FIG. 7
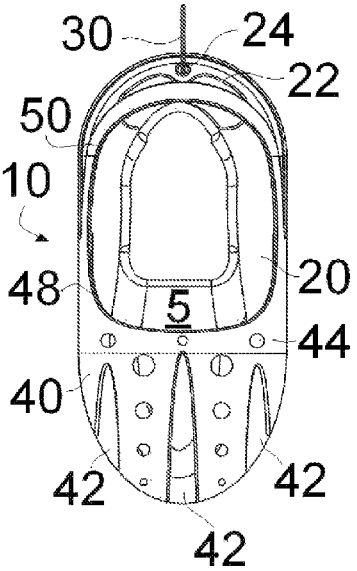
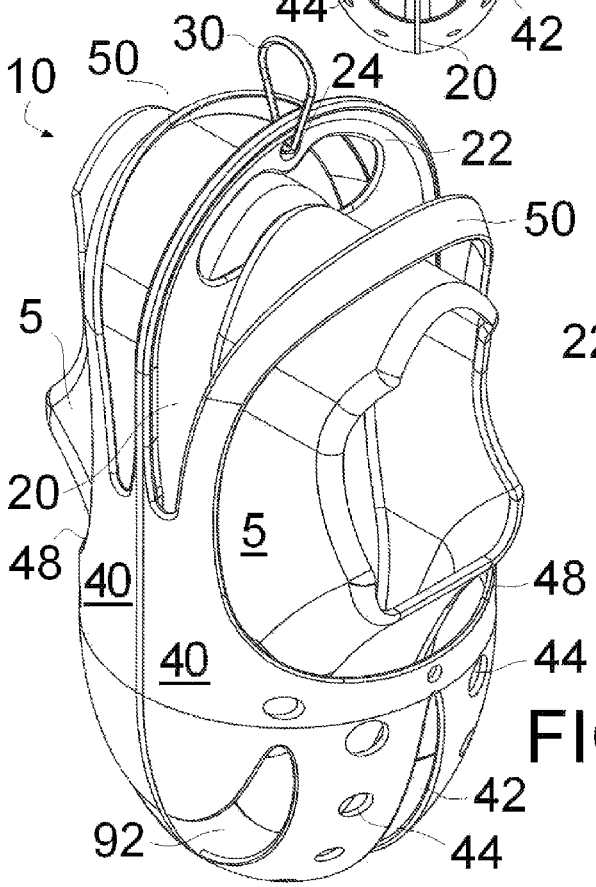
FIG. 5
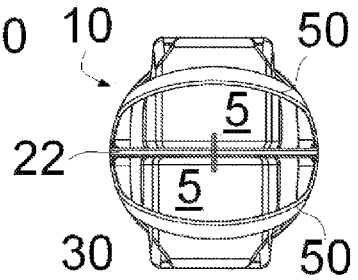
FIG. 8

FOOTWEAR CARRIER: SHOE HOLDING SUPPORT STRUCTURE

RELATED APPLICATIONS

This application claims the benefit of U.S. Provisional Patent Application No. 61/019,230, filed Jan. 4, 2008, entitled "Footwear Carrier: Shoe Holding Support Structure."

BACKGROUND OF THE INVENTION

1. Field of the Invention

The present invention pertains to footwear or shoe carriers, which are sometimes called shoe bags.

2. Background Information

Shoe or footwear carriers, also called shoe bags, are well known in the art. See, for representative examples, U.S. Pat. Nos. D140,519; 2,832,389; D395,752; D444,944; D453,994; D504,230; D547,063; 4,917,290; and 6,669,016.

Footwear carriers have been designed to simplify the carrying and storage of shoes. In many applications shoes that need to be transported do not fit easily into other carrying devices.

For example, in urban office environments it is common for workers to walk to work from a parking or public transportation location in walking shoes, such as tennis shoes, while carrying more office appropriate footwear. The office footwear does not easily fit into an office briefcase, or purse, that the worker may have on them.

As another representative example, gym patrons will often desire to have gym shoes transported outside of the gym bag itself, such as for space and/or aeration concerns. Further, gym patrons often utilize shower shoes or sandals for sanitary reasons, but have some difficulty in transporting wet shoes after the gym visit.

As another representative example, travelers often leave packaging shoes for last and shoes may not easily fit into the travel bags.

As another example, sporting participants often have specialized shoes for their sport, such as golf shoes, soccer shoes, baseball spikes, bowling shoes, which must be carried in a convenient fashion. Following use, it is often desirable to store the shoes in a place having a large amount of air flow.

For these, and other examples not listed herein, footwear carriers have been developed. However, there remains a need in the industry for providing an inexpensive, utilitarian, universal footwear carrying device to accommodate as least some of the footwear carrying needs. Further, as with footwear itself, it is helpful to provide such a carrier with a stylish flair.

SUMMARY OF THE INVENTION

The objects of the present invention are achieved with a light weight foot wear carrier according to the present invention which consists of a body defining two open cavities with a dividing wall between the cavities. Each body formed cavity is open on a "top end" there of for easy footwear insertion. The carrier has straps coupled to the body, which may be adjustable, to hold the footwear in a secure position inside the carrier, with one strap extending across each opening for each cavity. The footwear is held upright for ease of insertion and removal. The straps may be formed as integral or attached straps that may be elastomeric and/or adjustable to hold footwear of various geometries.

The open design allows user optimum viewing of the footwear for easy identification. An integrated handle provides user carrying options. An optional carabineer adds feature for easy and reliable hanging and attachment to bags, luggage, or the like.

The open design and multiple holes and open slots provide ease of drying and cleaning. The holes and slots also provide ventilation for the footwear, for drying and aeration.

The footwear carrier may be constructed of elastomeric or foam elastomer to provide: flexibility to adapt to shoe types and sizes and hold each snugly; ease of cleaning; access from right, left, top for shoe insertion and removal; water proof and UV resistant; ease of molding/demolding in this complex shape with multiple cutouts and undercuts; allows designs with or without buckle feature due to elongation/compliance ability of polymeric material.

These and other objects of the present invention will be clarified in the following description which is taken together with the attached figures in which like reference numerals represent like elements throughout.

BRIEF DESCRIPTION OF THE DRAWINGS

FIG. 5 is a perspective view of a footwear carrier in accordance with one aspect of the present invention illustrated with a schematic pair of shoes held therein;

FIG. 6 is a side view of the footwear carrier shown in FIG. 5;

FIG. 7 is a front view of the footwear carrier shown in FIG. 5;

FIG. 8 is a top view of the footwear carrier shown in FIG. 5;

DETAILED DESCRIPTION OF THE INVENTION

Figure 1:
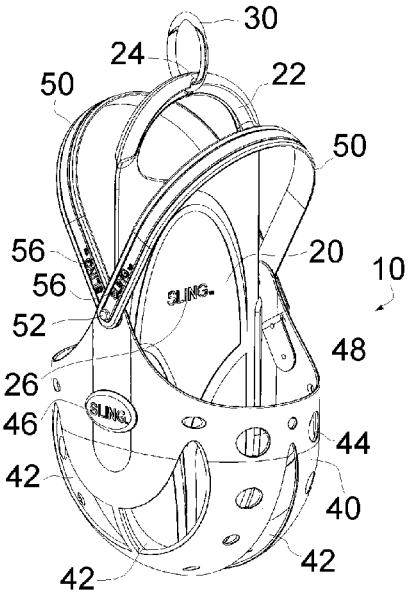
FIG. 1 is a perspective view of a footwear carrier in accordance with one aspect of the present invention illustrated, for clarity, without a pair of shoes held therein.
Figure 4:
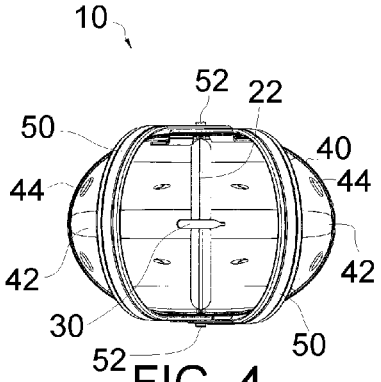
FIG. 4 is a top view of the footwear carrier shown in FIG. 1.
Figure 2:
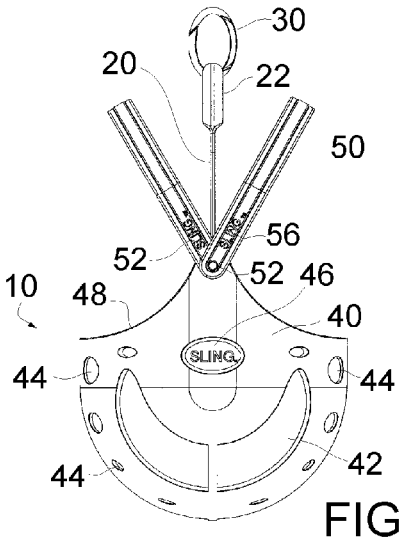
FIG. 2 is a side view of the footwear carrier shown in FIG. 1.
Figure 3:
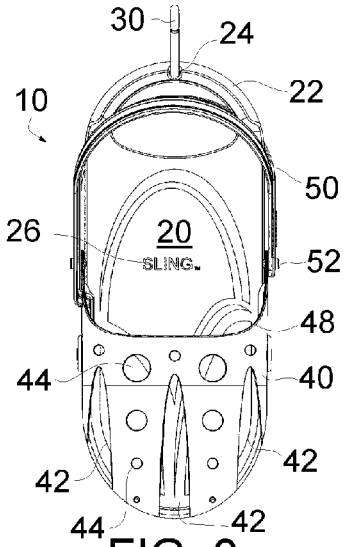
FIG. 3 is a front view of the footwear carrier shown in FIG. 1.

A complete understanding of the invention will be obtained from the following description when taken in connection with the accompanying drawing figures. It is also to be understood that the specific embodiments illustrated in the attached drawings, and described in the following specification, are simply exemplary embodiments of the invention. Hence, specific dimensions and other physical characteristics related to the embodiments disclosed herein are not to be considered as limiting.

The present invention provides a light weight foot wear carrier 10 according to the present invention which consists of a center divider or dividing wall 20 with a body 40 defining two open cavities with the dividing wall 20 between the cavities. The carrier 10 may be a one piece molded construction.

The dividing wall 20 preferably includes an integral handle 22. The handle 22 provides carrying options for the user and may be formed as an over-molded handle design for easy handling. The handle may include an attaching hole or opening 24 therein for receipt of a separate ring or hook or carabineer 30. The optional carabineer 30 adds a feature for easy and reliable hanging and attachment to bags, luggage, or the like. The dividing wall 20 can further include product labeling surfaces 26 to enhance branding possibilities.

The carrier 10 included a body 40 coupled to the dividing wall 20, and preferably formed integral with the wall 20. The body 40 defines two cavities with the wall between the adjacent cavities.

The body 40 includes a plurality of drainage slots 42 and aeration opening 44 to provide an open design. Grooves, slots and openings may be provided in the divider wall 20 to further assist these functions. The open design allows user optimum viewing of the footwear held in the carrier 10 for easy identification. The open design and multiple holes 44 and open slots 42 provide ease of drainage and drying of the shoes held in the carrier 10 and for the cleaning of the carrier 10 itself. The holes 44 and slots 42 thus provide ventilation for the footwear, for drying and aeration.

The body 40 forming each cavity is open on a top end there of at edge 48 for easy footwear insertion. The body 40 can further include product labeling surfaces 46 to enhance branding possibilities.

Figure 9:
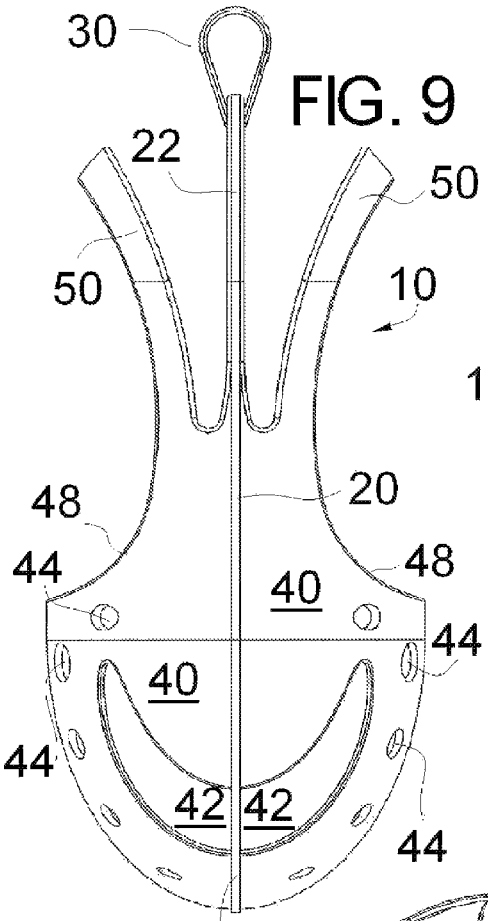
FIG. 9 is a side view of the footwear carrier shown in FIG. 5 with the footwear removed for clarity.
Figure 10:
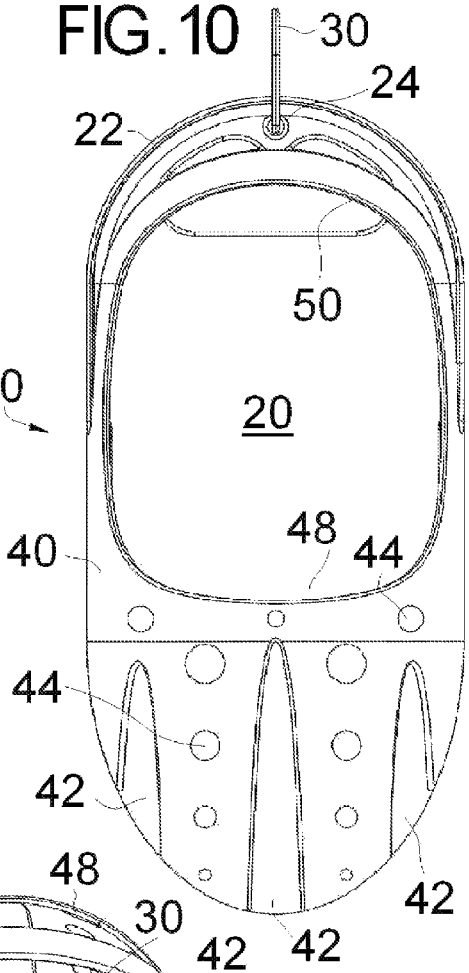
FIG. 10 is a front view of the footwear carrier shown in FIG. 9.
Figure 11:
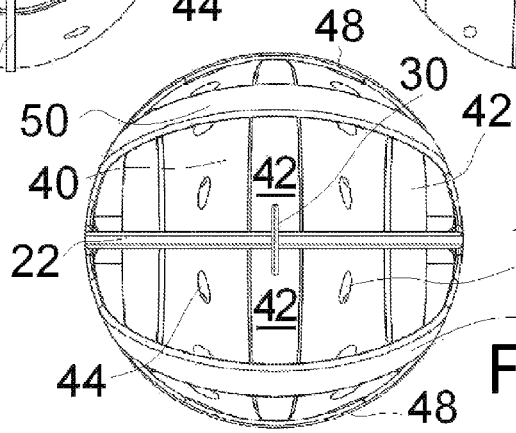
FIG. 11 is a top view of the footwear carrier shown in FIG. 9.

The carrier 50 has straps, which may be adjustable, attached to the body 40 to hold the footwear in a secure position inside the carrier 10, with one strap extending across each opening for each cavity. The footwear is held upright for ease of insertion and removal. The straps 50 may be formed as integral elastomeric straps as shown in FIGS. 5-9, that again, may be adjustable to hold footwear of various geometries. If the straps are sufficiently elastic, no adjustable feature is needed. If adjustment is desired a buckle attachment of two strap ends can be easily provided. The straps 50 may be formed as separate members attached to the body 40 through pivots 52.

The footwear carrier may be constructed of elastomeric or foam elastomer to provide: flexibility to adapt to shoe types and sizes and hold each snugly; ease of cleaning; access from right, left, top for shoe insertion and removal; water proof and UV resistant; ease of molding/demolding in this complex shape with multiple cutouts and undercuts; allows designs with or without buckle feature due to elongation/compliance ability of polymeric material. The product can be made of multiples parts, such as a center divider wall 20, Shoe Cup forming body halves 40 attached thereto, Straps 50 attached to the body, with a Logo patch or add on, and a separate Carabineer 30). The materials may be elastomeric and polymers such as ABS, PP, Polycarbonate used to provide a sufficiently rigid structure.

Although the present invention has been described above by reference to an embodiment of the invention, the present invention is not limited to the embodiments described above. Modifications and variations of the embodiment described above will occur to those skilled in the art, in light of the above teachings without departing from the spirit of the present invention. The present invention, therefore, to be limited only as indicated by the scope of the claims appended hereto and equivalents thereto.

What is claimed is:

1. A foot wear carrier comprises:

A dividing wall;

A body coupled to the dividing wall and defining two open cavities each configured to receive footwear there in, with the dividing wall between the cavities and extending along the length of the open cavities from a to end there-of, wherein each cavity is open on the top end there of with the dividing wall there-between the open top ends for footwear insertion into the open top end cavities; and one strap extending across each open to end of each cavity and configured to secure the footwear within the respective cavity.

2. The footwear carrier of claim 1 wherein the straps are formed as integral elastomeric straps which are integral with the dividing wall and the body.

3. The footwear carrier of claim 1 wherein the straps are formed as adjustable straps to hold footwear of various geometries.

4. The footwear carrier of claim 1 wherein the body forming the cavities are formed with a plurality of openings therein below the open top end which allows for user viewing of the footwear within the cavities for easy identification of the footwear by the user.

5. The footwear carrier of claim 1 further including an integral handle within the dividing wall.

6. The footwear carrier of claim 1 further including an attachment opening within the dividing wall configured to receive a carabineer.

7. The footwear carrier of claim 1 further including multiple holes and open slots within the body configured to provide for drying and aeration of the footwear within the cavities.

8. The footwear carrier of claim 1 wherein the carrier is an integral one piece structure molded from elastomeric material.

9. The footwear carrier of claim 1 wherein the carrier is an integral one piece structure molded from elastomeric foam material.

10. A shoe carrier comprises:

A dividing wall;

A body extending from the dividing wall defining two open cavities each configured to receive a shoe there in, with the dividing wall between the two open cavities and extending along the length of the open cavities from one end there-of, wherein each cavity is open on one end with the dividing wall between the open ended cavities; and Two straps attached to the body and each strap extending across one open end for each cavity and configured to secure a shoe within the respective cavity.

11. The shoe carrier of claim 10 wherein the straps are formed as elastomeric straps.

12. The shoe carrier of claim 10 wherein the straps are formed as adjustable straps to hold shoes of various geometries.

13. The shoe carrier of claim 10 wherein the straps are attached to the body through pivots.

14. The shoe carrier of claim 10 wherein the body forming the cavities are formed with a plurality of openings therein below the open end which allows user viewing of footwear held in the carrier.

15. The shoe carrier of claim 10 further including an integrated handle within the dividing wall.

16. The shoe carrier of claim 10 further including an attachment opening within the dividing wall configured to receive a carabineer.

17. The shoe carrier of claim 10 further including multiple holes and open slots in the body.

18. The shoe carrier of claim 10 wherein the divider and body is an integral one piece structure molded from elastomeric material.

19. The shoe carrier of claim 10 wherein the divider and body is an integral one piece structure molded from elastomeric foam material.

20. A foot wear carrier comprises:

A dividing wall having an integral handle;

A body formed integral with the dividing wall extending from the dividing wall defining two open cavities each configured to receive a shoe there in, with the dividing wall between the two cavities and extending along the length of the open cavities from one end there-of, wherein each cavity is open on one end with the dividing wall there-between; and Two straps attached to the body and each strap extending across one open end for each cavity and configured to secure a shoe within the respective cavity.

* * * * *

UNITED STATES PATENT AND TRADEMARK OFFICE

CERTIFICATE OF CORRECTION

PATENT NO. : 9,169,057 B2
APPLICATION NO. : 12/348883
DATED : October 27, 2015
INVENTOR(S) : Ryan Scott Bookhammer It is certified that error appears in the above-identified patent and that said Letters Patent is hereby corrected as shown below:

IN THE CLAIMS

Column 3,
Line 61-67 should read --

1. A foot wear carrier comprises: A dividing wall; A body coupled to the dividing wall and defining two open cavities each configured to receive footwear there in, with the dividing wall between the cavities and extending along the length of the open cavities from a top end there-of, wherein each cavity is open on the top end there Column 4,
Line 1-6 should read -- of with the dividing wall there-between the open top ends for footwear insertion into the open top end cavities; and one strap extending across each open top end of each cavity and configured to secure the footwear within the respective cavity.

Signed and Sealed this
Twenty-third Day of February, 2016

Michelle K. Lee

Michelle K. Lee
*Director of the United States Patent and Trademark Office*